US007168221B2

(12) United States Patent
Hunter, Jr.

(10) Patent No.: US 7,168,221 B2
(45) **Date of Patent: *Jan. 30, 2007**

(54) FIREPROOF SEAMLESS FOAM PANEL ROOFING SYSTEM

(76) Inventor: John P. Hunter, Jr., 344 Country Rd. 39A, Southampton, NY (US) 11968

( * ) Notice: Subject to any disclaimer, the term of this patent is extended or adjusted under 35 U.S.C. 154(b) by 291 days.

This patent is subject to a terminal disclaimer.

(21) Appl. No.: 10/750,397

(22) Filed: Dec. 31, 2003

(65) Prior Publication Data

US 2004/0200154 A1 Oct. 14, 2004

Related U.S. Application Data

(63) Continuation-in-part of application No. 10/601,046, filed on Jun. 21, 2003, now Pat. No. 7,036,285, which is a continuation of application No. 10/022,612, filed on Dec. 18, 2001, now Pat. No. 6,581,348.

(60) Provisional application No. 60/298,517, filed on Jun. 15, 2001.

(51) Int. Cl.
*E04B 1/00* (2006.01)
*E04G 21/00* (2006.01)
*E04G 23/00* (2006.01)

(52) U.S. Cl. ..... 52/746.11; 52/412; 52/309.5; 52/309.8; 52/408; 52/741.4; 156/71

(58) Field of Classification Search ..... 52/408, 52/409, 412, 746, 747.1, 741.4, 745.06, 309.5, 52/309.8, 746.11; 156/71, 78, 182; 428/319.1
See application file for complete search history.

(56) References Cited

U.S. PATENT DOCUMENTS

| | | | | |
|---|---|---|---|---|
| 4,739,603 | A * | 4/1988 | Butler | 52/750 |
| 4,745,032 | A * | 5/1988 | Morrison | 428/215 |
| 4,786,543 | A * | 11/1988 | Ferm | 428/138 |
| 5,037,685 | A * | 8/1991 | Richards et al. | 428/40.5 |
| 6,581,348 | B2 * | 6/2003 | Hunter, Jr. | 52/408 |
| 2003/0089061 | A1 * | 5/2003 | DeFord et al. | 52/309.9 |

* cited by examiner

*Primary Examiner*—Naoko Slack
*Assistant Examiner*—Chi Q. Nguyen
(74) *Attorney, Agent, or Firm*—Alfred M. Walker

(57) ABSTRACT

A crush resistant seamless roofing system is formed by a layer of adjacent panels having loose joints filled by expanding rising foam adhesive, which is trimmed to remove excess foam adhesive above a top plane of the roofing system. The roofing system thus formed is covered by a fabric layer and a coating. Further, the seamless roofing system is combined with a base layer, located beneath the panels, the base layer comprising bonded panels of a lightweight fireproofing material, resistant to moisture and foot traffic.

5 Claims, 6 Drawing Sheets

Figure 9
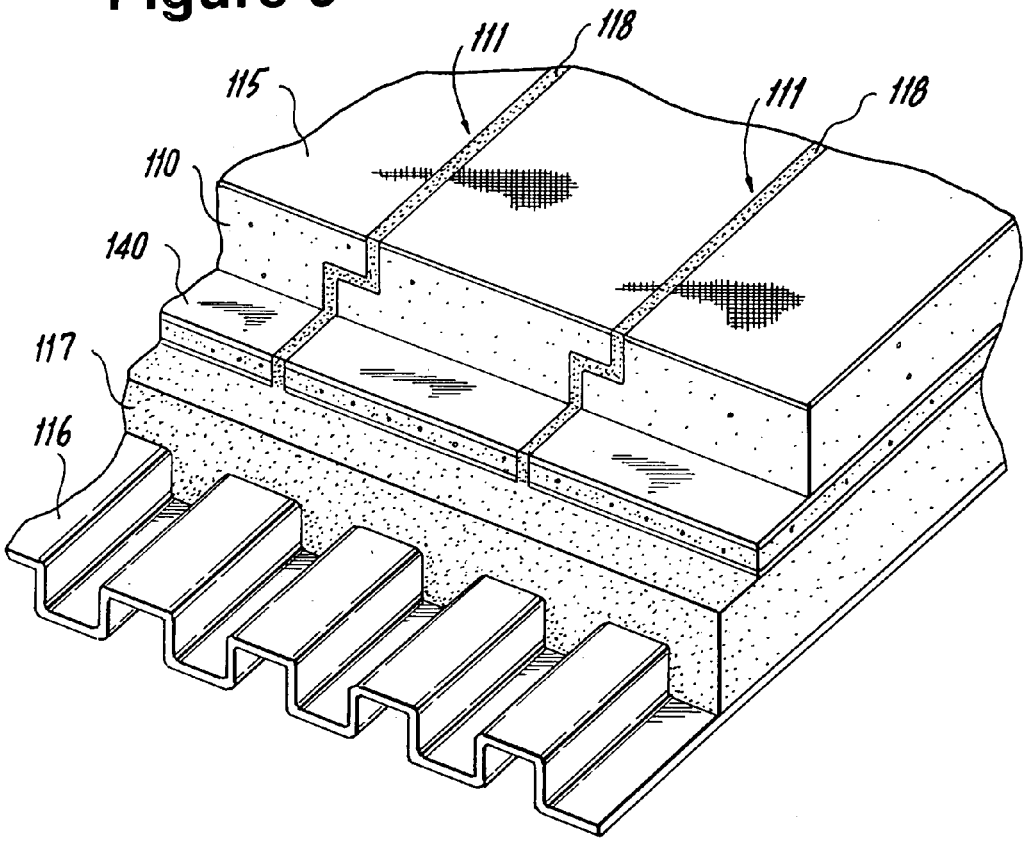
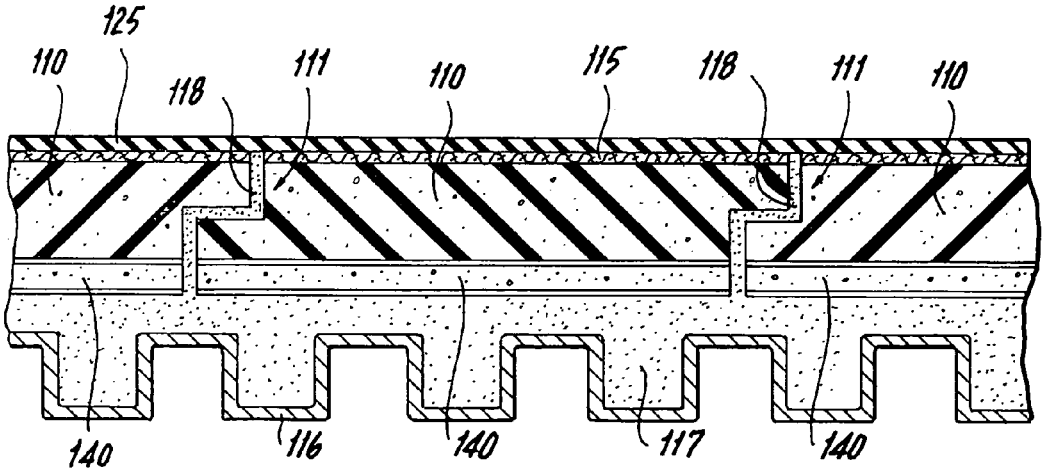
Figure 10

FIREPROOF SEAMLESS FOAM PANEL ROOFING SYSTEM

RELATED APPLICATIONS

This application is a continuation in part of application Ser. No. 10/601,046 filed Jun. 21, 2003 now U.S. Pat. No. 7,036,285, which is a continuation of application Ser. No. 10/022,612 filed Dec. 18, 2001 now U.S. Pat. No. 6,581,348, which claims benefit from provisional application Ser. No. 60/298,517 filed Jun. 15, 2001.

FIELD OF THE INVENTION

The present invention relates to roofing systems.

BACKGROUND OF THE INVENTION

Rigid foam panels for providing a roofing membrane layer are currently available for use as an insulating underlayment in roof construction. Typically these are 4' by 8' (1.22 m by 2.44 m) panels 1.5" (3.8 cm) thick made of a 1.6 pound per cubic foot polyurethane foam with a tar paper top layer. Such a material is not crush resistant enough to be used as a roof surface material and can also be easily punctured.

Core panels are common in the art and may be used in conjunction with a roof membrane layer. The functions of core panels include providing a fireproofing layer; providing a thermal barrier; providing a solvent barrier or moisture barrier; and providing an air barrier. One form of core paneling is a fiberglass-faced asphaltic board. Asphaltic boards are known to provide adequate moisture resistance, but may not serve as a fire barrier.

A second type of core panel is a semi-rigid rock wool or fiberglass. Boards of this type are permeable to moisture, provide little impact resistance, and do not provide a fire barrier.

A third type of core panel known in the art is a plywood, or veneer, sheet. Veneer sheets are combustible, however. Further, plywood sheets lose strength when wet, yet provide adequate strength for foot traffic.

A fourth type of core panel is a wood fiberboard, comprising organic fibers bonded with resin. Fiberboard is also combustible and loses strength when wet. Fiberboard provides at least some foot traffic protection, but crumbles when wet.

A fifth type of core panel is perlite, comprising a mineral aggregate board with cellulose binders and sizing agents. A perlite core panel may be used as a fire barrier. However, perlite core panels may fall apart when wet and are crushed by foot traffic.

A sixth type of core panel is a panel comprising a gypsum core with paper facers on each side. Paper-faced gypsum boards may be used in fire protection and provide moderate resistance to foot traffic. However, the paper facers may delaminate when wet.

In addition to the common type of core panels mentioned above, improved core panels exist providing properties specific to use. One example of an improved core panel is the Dens-Deck® Roof Board. This Roof Board comprises a high-density gypsum core and fiberglass mats embedded on both sides. The Roof Board may include a fireproofing layer, which may be as thin as ¼ inch. Such core panels may neither delaminate with moisture nor support mold growth. Furthermore, Roof Boards may support foot traffic and resist hail.

More specifically, core panels as described herein serve to support a roofing membrane and may be structurally located beneath a roofing membrane. The roofing membrane may adhere to the Dens-Deck® Roof Board directly. Typically, the edges of the Dens-Deck Roof Board should be butted together. However, for the condition of high gain in surface temperature, slight gaps may be required.

Optionally, a separating material may be used between the core panel and the roofing membrane. Further, several methods known in the art may be utilized to bond the separated core panels. One such method is known as "hot-mopping." A second method of bonding core panels is known as "torching." Torching may involve the application of a bitumen membrane, such as a "Dibiter APP modified bitumen member," atop the core panels. The bitumen membrane, or "flashing member," may then be positioned by the application of a heat-welding technique.

OBJECTS OF THE INVENTION

It is therefore an object of the present invention to provide a sturdy, weatherproof seamless roofing system that uses rigid foam boards or panels to create a seamless waterproof roof.

SUMMARY OF THE INVENTION

The roofing panels of this invention differ from the prior art underlayment product in several respects. The panels of this invention are:

a) made of a denser polyurethane foam (approximately 3 pounds per cubic foot) and, b) include an integral top layer of non-woven 250 gram polyester fabric that is saturated by the foam during manufacture by the laminator in a controlled factory environment.

The higher density affords more crush resistance, while the well bonded top layer resists punctures and provides a better adhesion surface for elastomeric top coats.

The roofing panels are bonded to roof substrate with low rise foam polyurethane adhesive which seeps through loose tongue-in-groove joints to form a blob at the top, which is shaved off and covered with a fabric top layer.

After the adhesive cures, a very secure bond between the panels results.

The low-rise foam adhesive is a two-part mixture that has distinct phases after mixing. By varying the formulations of the two parts, the "cream time" (i.e.—to achieve the consistency of shaving cream) as well as the "tack free" time can be controlled.

The panels are placed on the foam just after cream consistency and well before tack-free time so that the foam rises through the joints. After the adhesive cures to a solid consistency, the blobs are removed from all of the joints. This is typically accomplished by grinding using a disk pad grinder.

The roof is finished by applying a layer of waterproof elastomeric coating which covers the entire surface creating a monolithic structure.

BRIEF DESCRIPTION OF THE DRAWINGS

The present invention can best be understand in connection with the accompanying drawings, in which:

FIG. 9 is a perspective cutaway view, detailing the layering of a fireproof roofing system having a corrugated roof deck;

FIG. 10 is a side elevational cutaway view thereof, detailing the incorporated layers of a fireproof gypsum layer;

DETAILED DESCRIPTION OF THE INVENTION

The roofing system of this invention uses rigid foam boards or panels to create a seamless waterproof roof. It can be used over a number of different substrates including metal decking, tar and gravel, or polyurethane foam in new construction as well as re-roofing applications.

Rigid foam panels are currently available for use as insulating underlayment in roof construction. Typically these are 4' by 8' (1.22 m by 2.44 m) panels 1.5'" (3.8 cm) thick made of a 1.6 pound per cubic foot polyurethane foam with a tar paper top layer. Such a material is not crush resistant enough to be used as a roof surface material and can also be easily punctured.

The roofing panels of this invention differ from this underlayment product in several respects. Although panel size as well as material are similar, the panels of this invention are made of a denser polyurethane foam (approximately 3 pounds per cubic foot) and include an integral top layer of non-woven 250 gram polyester fabric that is saturated by the foam during manufacture by the laminator in a controlled factory environment. The higher density affords more crush resistance, while the well bonded top layer resists punctures and provides a better adhesion surface for elastomeric top coats.

Figure 1:
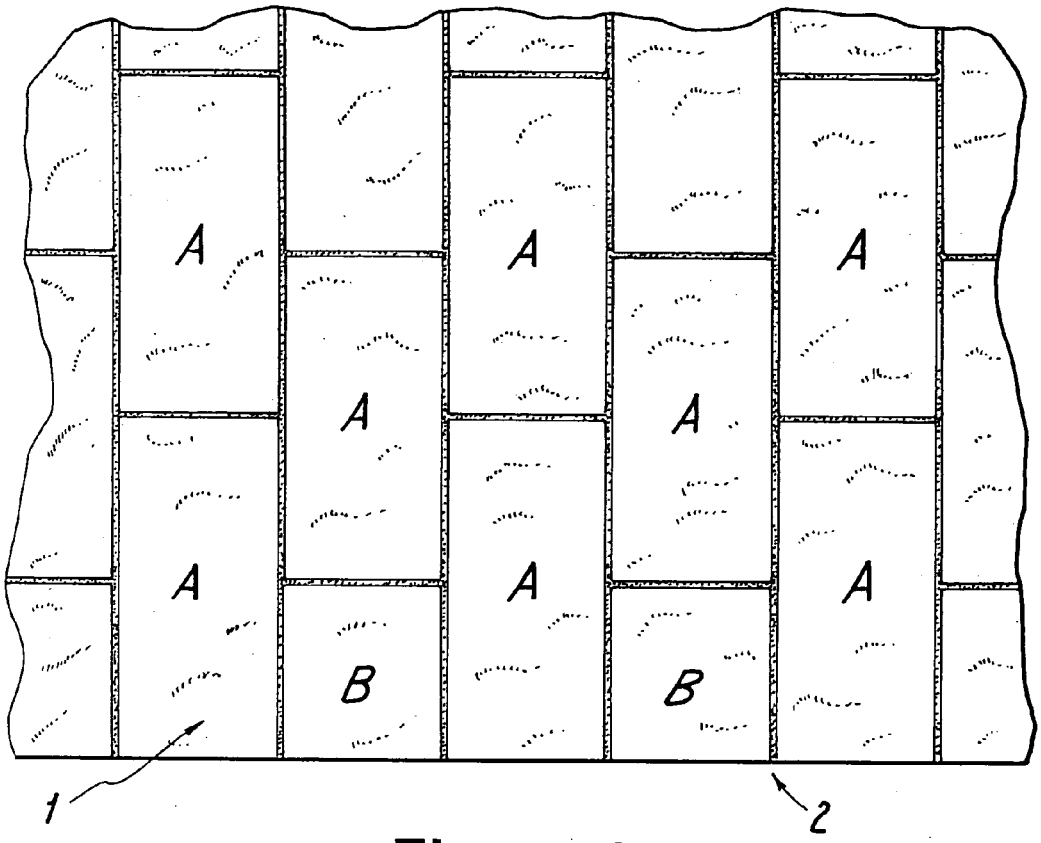
FIG. 1 is a top plan view of a roof section; showing outlines of roofing panels of this invention.

FIG. 1 is a top view of a roof 1 section showing the outline of the individual roof panels. The panel seams are staggered by using alternate whole panels A as well as half panels B at the roof edge 2. This is done to prevent any tendency for propagation of inadvertent seam separations.

Figure 2:
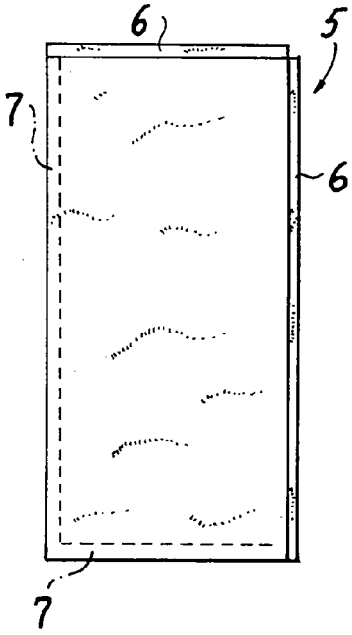
FIG. 2 is a top plan view of an embodiment for a tongue-in-groove roofing panel of this invention.

FIG. 2 shows a top view of a tongue-in groove panel 5, tongue edges 6 and groove edges 7.

Figure 3:
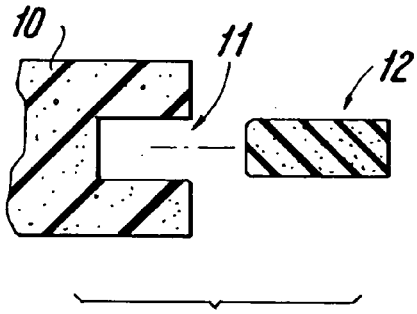
FIG. 3 is an edge cross-section detail view of further embodiment for an all-groove panel of this invention with an insertable tongue board.

Since a protruding tongue of polyurethane foam could be damaged in transit, an alternate embodiment of a tongue-in groove construction is shown in FIG. 3. In this all-groove construction, each polyurethane panel 10 has grooves 11 cut in all four edges. A length of polyurethane plank 12 is then inserted in groove 11 on two edges at the work site. Plank 12 is dimensioned as a press fit in groove 11 and protrudes from the edge to form the tongue after insertion. Planks 12 would be shipped separately in protective packaging to the work site.

Figure 4:
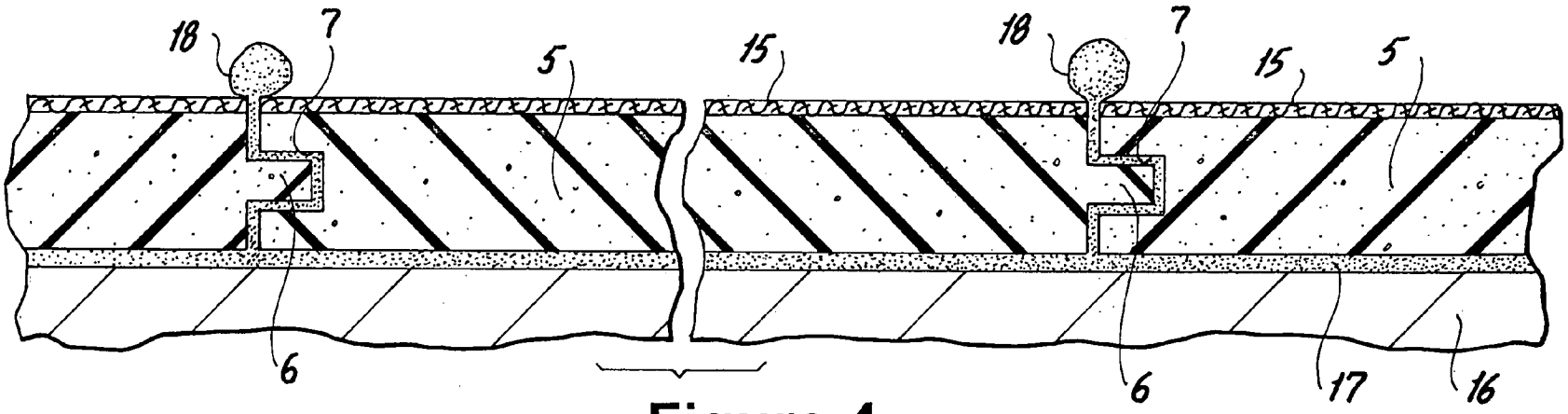
FIG. 4 is an edge cross-section view of yet another embodiment for tongue-in-groove roofing panels of this invention, shown adhesively bonded to a roof substrate.

FIG. 4 is an edge cross-section view of roofing panels 5 bonded to roof substrate 16 with low rise foam polyurethane adhesive 17 which seeps through loose tongue-in-groove joints to form a blob 18 at the top. Factory bonded fabric 15 is a top layer. Typically, the groove 7 is ⅞" (22 mm) wide while the tongue is ¾" (19 mm) wide; this affords enough space for the adhesive foam to rise through while affording close line-up of the top surfaces of adjacent boards 5. After adhesive 17 cures, a very secure bond between panels 5 results.

Figure 5:
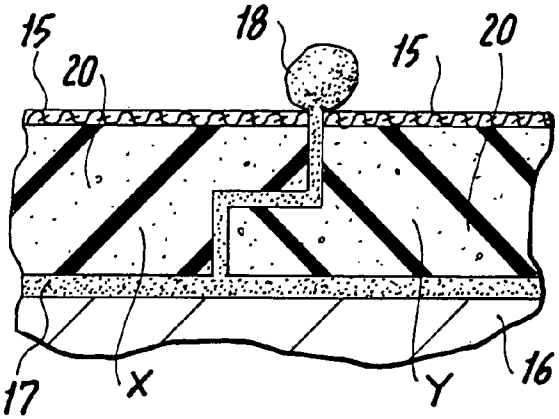
FIG. 5 is an edge cross-section detail view of a still further alternate embodiment of this invention, shown with a ship-lap joint configuration.
Figure 7:
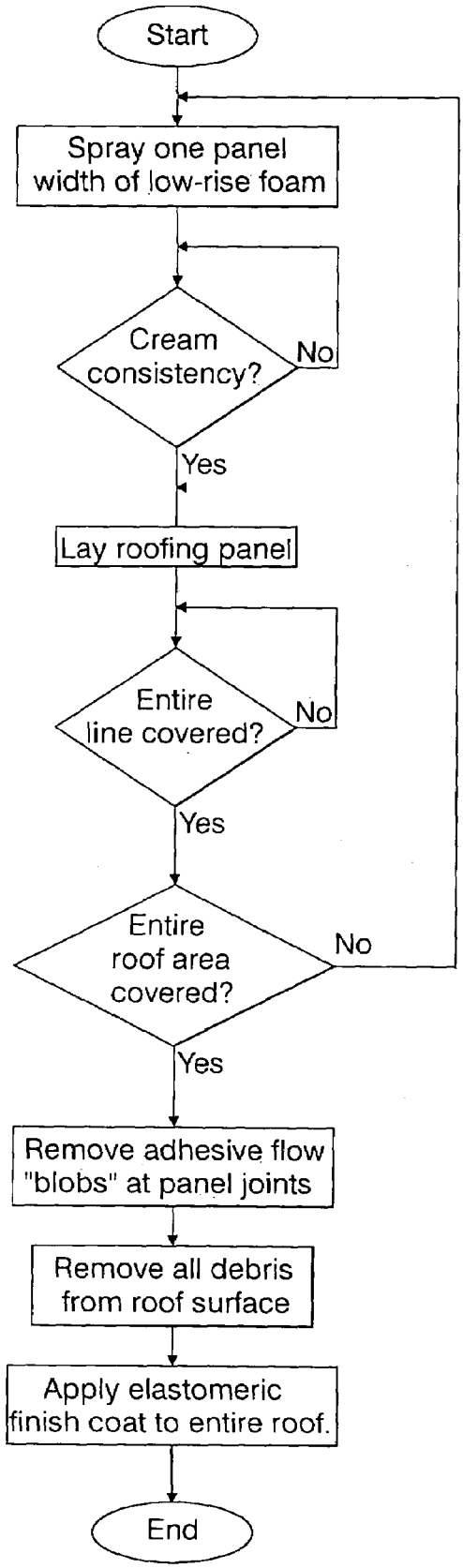
FIG. 7 is a high level flow chart of the roofing system method of this invention.

FIG. 5 is a detail of an alternative panel joint. Here panels 20 have a ship-lap edge which is also dimensioned so as to permit rising foam adhesive to flow through the joint. For ship-lap panels 20, the order in which they are laid into the foam is important.

As shown in FIG. 5, panel X should be laid down before panel Y so that there would not be a tendency to lift panel Y during the foam rising phase.

Foam adhesive is a two-part mixture that has distinct phases after mixing. By varying the formulations of the two parts, the "cream time" (i.e.—to achieve the consistency of shaving cream) as well as the "tack free" time can be controlled. For this invention, a cream time of about 1 minute and a tack-free time of about 4 minutes is ideal. The panels are placed on the foam just after cream consistency and well before tack-free time so that the foam rises through the joints.

After the adhesive cures to a solid consistency, the blobs 18 are removed from all of the joints. This is typically accomplished by grinding using a cutter, such as a knife or disk pad grinder. At this stage, the joint is flush with the fabric top surface of the adjacent panels.

The roof is finished by applying a layer of waterproof elastomeric coating which covers the entire surface creating a monolithic structure.

Figure 6:
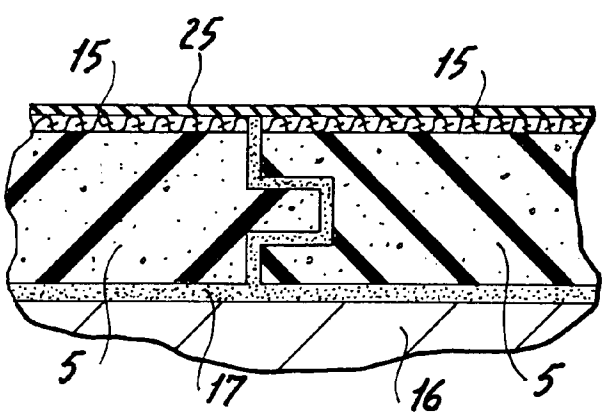
FIG. 6 is an edge cross-section detail view showing a panel joint of this invention in a finished roof section.

FIG. 6 is a detailed view of a finished joint between two panels 5 after the blob 18 has been removed and elastomeric coating 25 has been applied. Coating 25 can be an acrylic, urethane or silicone material. It can be sprayed or brushed on.

Flow chart 7 is a concise description of the overall installation process. Two people are generally involved as a team. One worker sprays a panel-width line of low rise polyurethane adhesive, while the second worker follows (after the mix is of cream consistency) and lay down panels. As per FIG. 1, the first panel at an edge is either a full or half panel to create the staggered seam pattern. Only after the entire roof (or large section) is paneled, are the seep-through joint blobs removed. All debris must be removed carefully before a final seal coat is applied.

Penetrations and wall flashings are first sealed with spray foam prior to sealing.

Figure 8:
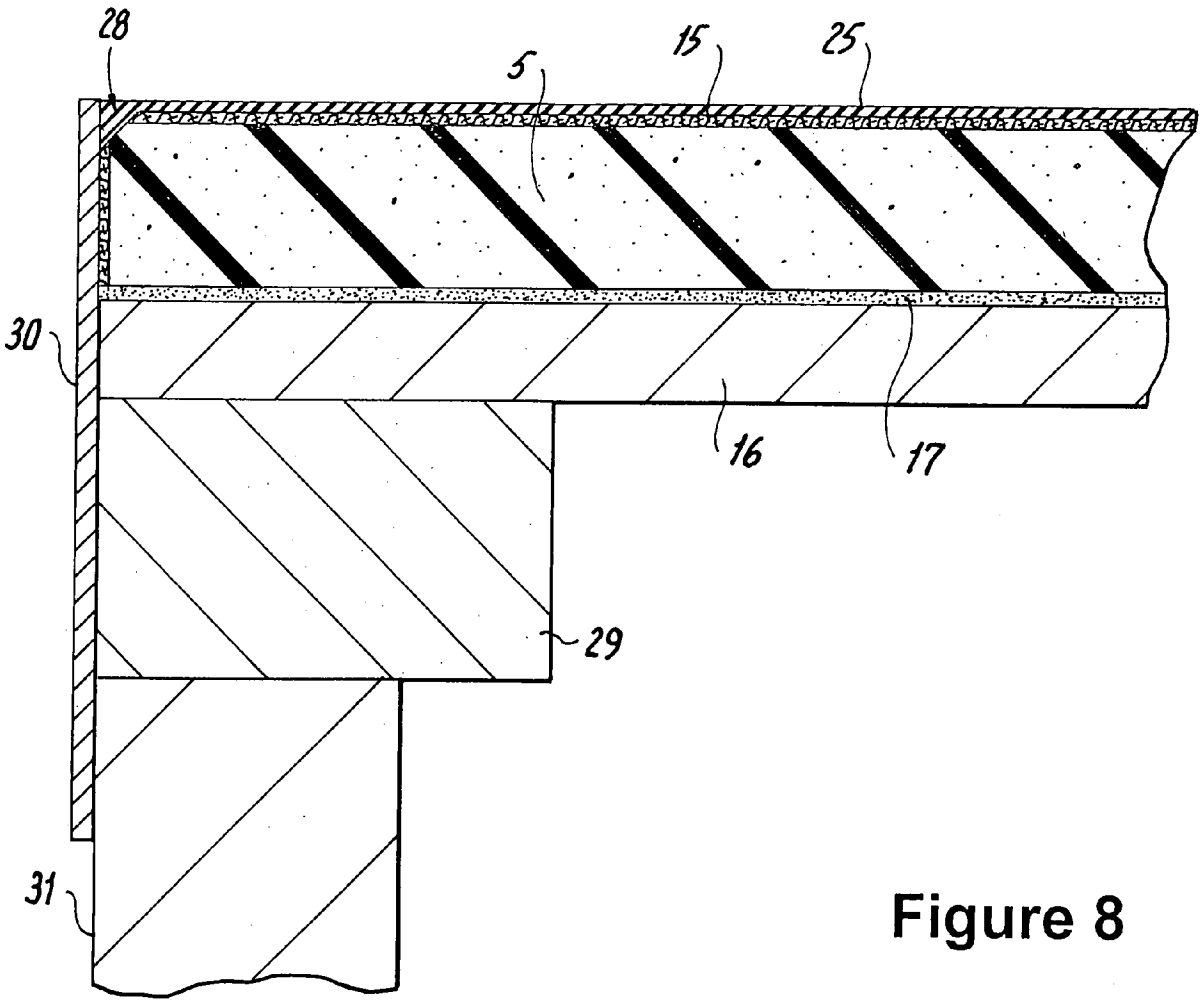
FIG. 8 is a roof edge detail view in cross-section, illustrating flashing and interfacing to the roofing system of this invention.

FIG. 8 is a detail at a roof edge showing an end panel 5 interfacing with aluminum edging 30 which bridges wall 31, beam 29 and foam panel 5. A V-groove 28 is cut from the corner of panel 5 at the juncture of edging 30 to permit an aluminum surface to be bonded and sealed to the fabric 15 top layer by waterproof coating 25.

FIG. 9 is a stepped cutaway view of a further embodiment for a fire resistant roof panel 110 having fireproof panel 140 attached thereto, wherein panel 110 with fireproof layer 140 is attached to roof deck 116 by in-situ applied foam layer 117, which rises through crevices 111 between adjacent panels 110. FIG. 10 is a side elevational crossectional view thereof.

For example, FIGS. 9 and 10 show first a structural deck 116 (corrugated deck members shown as an example). Above the structural deck 116 is in-situ deposited layer 117 of rising foam, which rises as protruding foam intrusions 118 through the crevice gaps 111 between discrete cured foam panels 110, similar to the rise of foam protrusions 18 from in-situ base foam layer 17 between panels 10 shown in FIGS.1–6.

FIGS. 9 and 10 also show the protruding foam 118 also going optionally downward in the indentations of the corrugated structural deck 116. Such would not happen if panel 110 was applied to a roof deck 16 which was entirely flat, as in FIGS. 4–6, but would be the case if the rising foam underlayer 117 were applied to a corrugated structural deck 116. It is anticipated that the fire resistant embodiment shown in FIGS. 9 and 10 can be applied to either a corrugated roof deck 116 or to a flat roof deck 16, as in FIGS. 4–6.

The next layer shown in FIGS. 9 and 10 is a fireproof gypsum layer 140, such as manufactured by DENSDECK®, adhered to the bottom of the upper discrete panels 110. Above panels 110 is a mesh layer 115. Not shown in FIGS. 9 and 10 are the excess globs of risen foam which are shaved off of the tops of rising foam protrusions 118, as well as the overlay of a waterproof coating outer skin layer 125 above fabric mesh 115.

Figure 11:
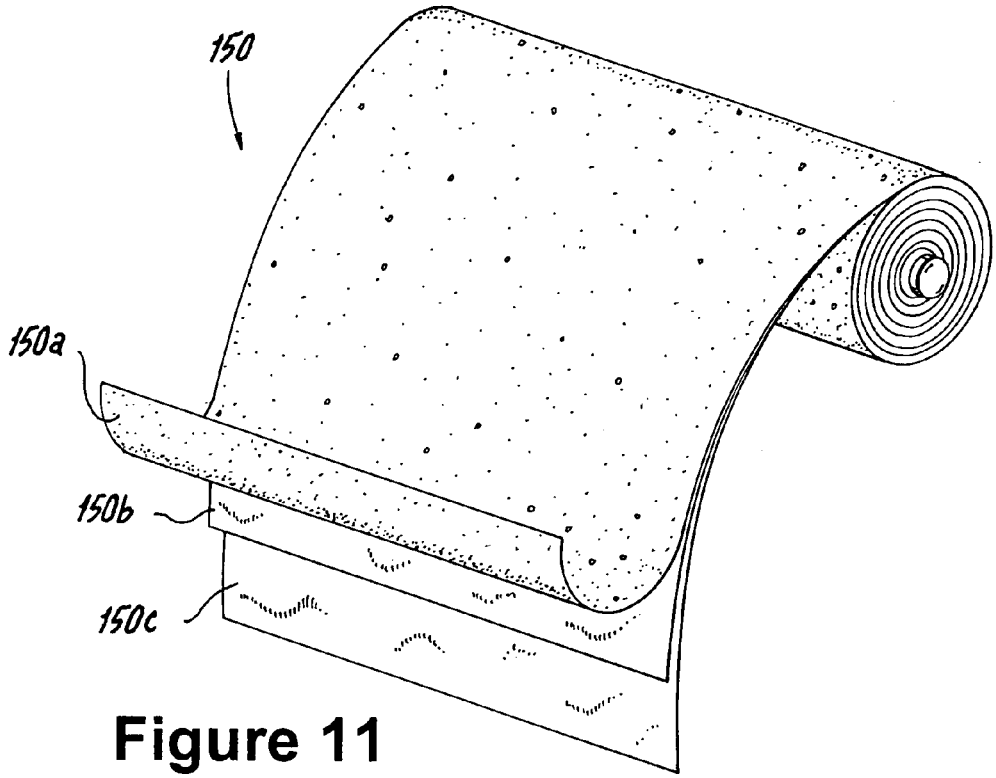
FIG. 11 is a perspective view of a rolled conventional multi-ply sheet of bitumen compound material for use with the roofing system according to another fireproof embodiment of the current invention.

FIG. 11 shows an optional rolled conventional multi-ply sheet of bitumen compound material 150, including slate granule covered upper layer 150*a* of a modified bitumen compound, middle polyester reinforcement layer 150 and lower layer 150*c* of a modified bitumen compound. Bitumen sheet 150 could be optionally placed adjacent to the fireproof gypsum layer 140 and/or the discrete foam panel 110.

Figure 12:
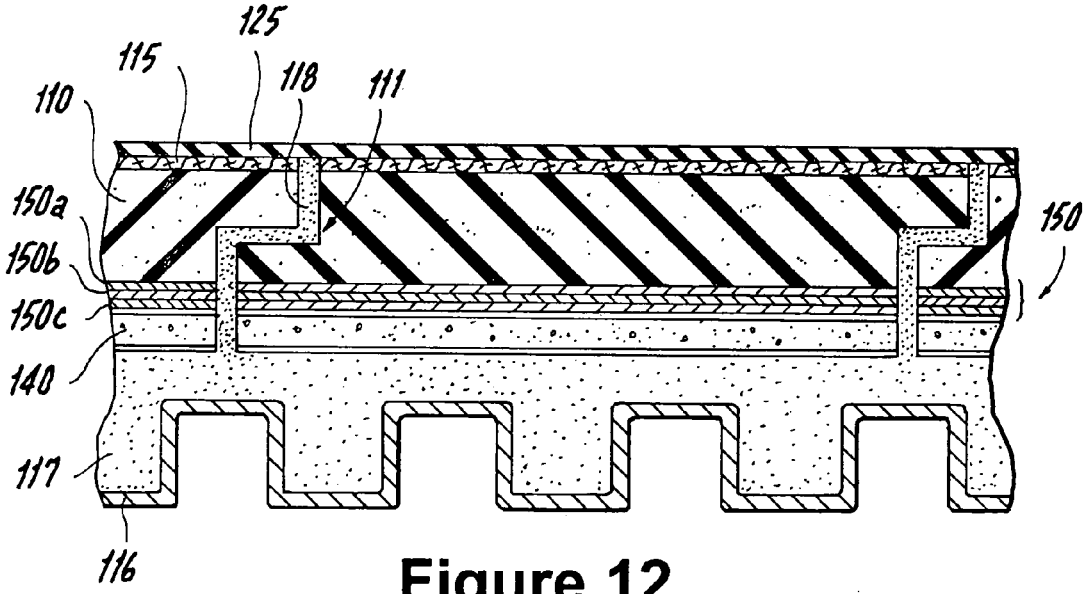
FIG. 12 is a cross-sectional view of a fireproof roofing system according to an embodiment of the current invention further utilizing the rolled conventional multi-ply sheet of bitumen compound material of FIG. 11.

FIG. 12 is a crossectional cutaway view of another embodiment for a fire resistant roof section, showing the lower in-situ foam layer 117, with a protruding portion 118 of the foam layer 117 shown having risen vertically up through the recess gap 111, between adjacent discrete foam panels 110, having the fireproof gypsum layer 140 attached at a bottom edge thereof.

The gypsum layer 140 shown in FIGS. 11 and 12 may expand or contract under adverse temperature conditions. The risen foam 118 is slightly resilient, so it may squeeze inward slightly, if the gypsum board layer 140 expands under conditions of high gain in surface temperature.

It is further noted that other modifications may be made to the present invention, within the scope of the invention, as noted in the appended Claims.

I claim:

1. A method of installing fire resistant roofing tiles comprising:

a) spraying a foam rising adhesive on a surface;

b) waiting for said foam rising adhesive to obtain a creamy consistency;

c) applying a first tile panel and an adjacent first subsequent tile panel to said surface; each said tile panel having a respective fire resistant layer adhered thereto;

d) waiting for said adhesive to cure and rise within a joint formed between said first tile panel and said first subsequent tile panel;

e) applying further tile panel and subsequent further tile panel to said surface;

f) waiting for said adhesive to cure and rise within further joints formed between said first subsequent tile and said further tile panel;

g) repeating steps "c", "d" and "e" and "f" on next subsequent pairs of tile panels until said foam adhesive completes rising between said joints and accumulates as debris above a plane formed by said tile panels accumulated in a seamless configuration;

h) removing debris formed by said foam rising adhesive from the top surface of said tile panels; and, i) applying an elastomeric coat to the top surface of said joined, seamless accumulation of tile panels.

2. The method of installing roofing tiles according to claim 1, wherein said elastomer is an acrylic.

3. The method of installing roofing tile panels according to claim 2, wherein application of said first and said subsequent tile panels further comprises:

applying said first tile panel having a first length; and applying said second tile panel having a second length, wherein said second length of said second tile panel is different than said first length of said first tile panel.

4. The method of installing roofing tiles according to claim 1, wherein said elastomer is a urethane.

5. The method of installing roofing tiles according to claim 1, wherein said elastomer is silicone based.

* * * * *